US009095745B2

(12) United States Patent
Chiang

(10) Patent No.: US 9,095,745 B2
(45) **Date of Patent: *Aug. 4, 2015**

(54) SWIMMING GOGGLES

(71) Applicant: Global Esprit Inc., New Taipei (TW)

(72) Inventor: Herman Chiang, New Taipei (TW)

(73) Assignee: GLOBAL ESPRIT INC., New Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 14/453,613

(22) Filed: Aug. 6, 2014

(65) Prior Publication Data

US 2014/0345038 A1 Nov. 27, 2014

Related U.S. Application Data

(63) Continuation-in-part of application No. 13/936,111, filed on Jul. 5, 2013, now Pat. No. 8,955,170.

(30) Foreign Application Priority Data

May 9, 2013 (TW) ..... 102208626 U
Jul. 11, 2014 (TW) ..... 103212375 U

(51) Int. Cl.
*A61F 9/02* (2006.01)
*A63B 33/00* (2006.01)

(52) U.S. Cl.
CPC ..... *A63B 33/002* (2013.01)

(58) Field of Classification Search
CPC ..... A63B 33/002
USPC ..... 2/442, 426, 427, 428, 431, 439, 440, 2/452
See application file for complete search history.

(56) References Cited

U.S. PATENT DOCUMENTS

| | | | | |
|---|---|---|---|---|
| 5,706,527 | A * | 1/1998 | Kita et al. | 2/452 |
| 6,023,791 | A * | 2/2000 | Chiang | 2/441 |
| 6,112,334 | A * | 9/2000 | Chiang | 2/428 |
| 6,513,170 | B1 * | 2/2003 | Chiang | 2/428 |
| 7,007,310 | B2 * | 3/2006 | Chiang | 2/446 |
| 7,159,250 | B2 * | 1/2007 | Chiang | 2/428 |

* cited by examiner

*Primary Examiner* — Tejash Patel
(74) *Attorney, Agent, or Firm* — Cheng-Ju Chiang

(57) ABSTRACT

Swimming goggles comprise a left frame body, a right frame body, lenses, protective pads and head strap bases, wherein each of the left and right frame bodies has an inner peripheral face and an outer peripheral face, and the inner peripheral face forms a hook channel therealong; each of the protective pads are attached to the inner peripheral faces and has a face contact portion and a connecting portion, characterized in that a backup ring is disposed between the connecting portion and the hook channel, and has a first peripheral face and a second peripheral face, such that the first peripheral face integrally encompasses the hook channel of the inner peripheral face and also the second peripheral face forms with the connecting portion, thereby, the swimming goggles could be worn comfortably in swimming.

10 Claims, 7 Drawing Sheets

SWIMMING GOGGLES

CROSS REFERENCE

The present invention, "swimming goggles" seeks to be a continuation-in-part application of the invention of U.S. patent application Ser. No. 13/936,111, filed Jul. 5, 2013, the contents of which are incorporated by reference herein in their entirety for all intended purposes.

BACKGROUND OF THE INVENTION

1. Field of the Invention

The present invention relates to swimming goggles, and particularly to swimming goggles capable of being worn comfortably and ergonomically without water leakage, reducing water resistance and providing a better range of visual field in swimming.

2. Related Art

Conventional racing swimming goggles are designed to fit for a contact portion corresponding to inner peripheries of each eye socket of the cranium at a wearer's face to lower the water resistance in swimming Conventional racing swimming goggles are made of a hard material to integrate lenses and a frame together, wherein the frame is not provided with a protective pad to contact a wearer's face. As a result, the wearer has to bear the uncomfortable feeling caused by directly contacting the hard material of the frame, and also, the problem of water leakage may arise because of the incomplete attachment to the wearer's face. Accordingly, another type of conventional racing swimming goggles is provided with a protective pad on sides of a frame to contact the face so as to overcome the problems of uncomfortable wearing feeling and of water leakage. However, the protective pad has a shape of an inverted J in cross section, and the J-shaped protective pad is attached to an area formed by eyebrows and the zygomatic bone in a frontward direction; that is to say, the J-shaped protective pad is not attached to the aforementioned contact portion, which easily causes the frame to stick out of the forehead, as seen from a side view, as well as increases water resistance when swimming forward. Furthermore, because the frame goes beyond wearer's forehead, and lenses of conventional swimming goggles are inclined with respect to wearer's eyes after being worn, the field of vision at corners of a wearer's eyes are being blocked by the frame.

In view of this, the inventor of the present invention is to develop a novel type of swimming goggles (an invention of a copending application with Application no. 102208626 for Taiwan patent application; application Ser. No. 13/936,111 for U.S. patent application; and Application no. 201320291564.6 for China patent application) having protective pads capable of fitting to the face portions with respect to the inner peripheries of the eye sockets of the cranium, by which some flaws of the conventional racing swimming goggles can be avoided successfully. Since the flaws found in the conventional racing swimming goggles have been solved, a new problem arises in the conventional racing swimming goggles is further considered, that is, swimmers who have longer eyelashes may feel uncomfortable and annoyed while their eyelashes touch the lenses of swimming goggles. Thus, there is a need for a further improvement of the swimming goggles.

SUMMARY OF THE INVENTION

Accordingly, an object of the present invention is to provide swimming goggles for racing and fitting to face portions with respect to inner peripheries of eye sockets of a cranium of a wearer so as to be worn comfortably without water leakage and to reduce water resistance in swimming.

To achieve the above-mentioned objects, the swimming goggles comprise a left frame body, a right frame body, lenses, a connecting element, protective pads and head strap bases, wherein the left frame body and the right frame body respectively have an inner peripheral face and an outer peripheral face, and a hook channel extends from and along the inner peripheral face of each of the left and right frame bodies; the lenses are defined into first inclined faces and second inclined faces by fold lines; the connecting element is disposed between the left frame body and the right frame body; protective pads respectively attached to the inner peripheral faces of the left and right frame bodies, each of the protective pads having a face contact portion and a connecting portion; wherein contours of the face contact portions are fit to the face portions with respect to the inner peripheries of the eye sockets of the cranium, characterized in that backup rings are disposed between the connecting portion and the hook channel of the left and right frame bodies, each of the backup rings forming a first peripheral face and a second peripheral face, wherein when configured, the first peripheral face integrally encompasses the hook channels of the inner peripheral faces and the second peripheral face is formed with the connecting portion, so as to be worn comfortably in swimming.

In accordance with the present invention, the second peripheral face is positioned on a side of the connecting element and forms an arc surface, and a tangent line of the arc surface and a Y axial line passing through the point of tangency cooperatively form an angle less than 90 degree, whereby making the left frame body and the right frame body perfectly fit into both sides of the bridge of nose without further adjustments after wearing.

DESCRIPTION OF THE PREFERRED EMBODIMENTS

Figure 5:
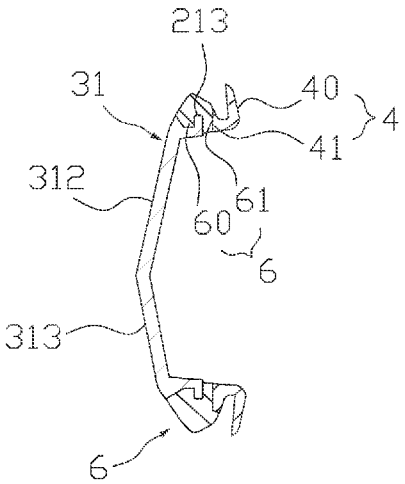
FIG. 5 is a cross-sectional view taken along lines 5-5 of FIG. 4.
Figure 6:
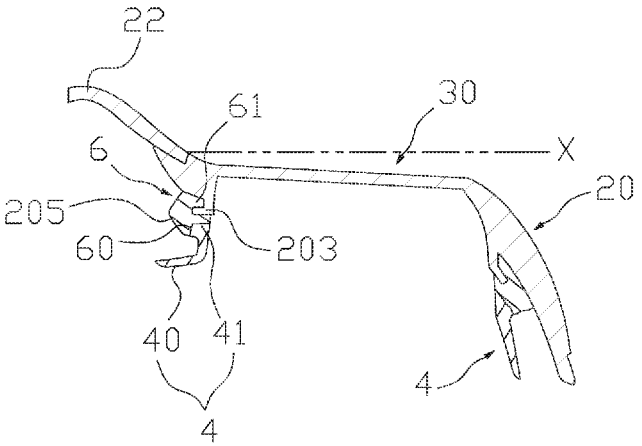
FIG. 6 is a cross-sectional view taken along lines 6-6 of FIG. 4.
Figure 7:
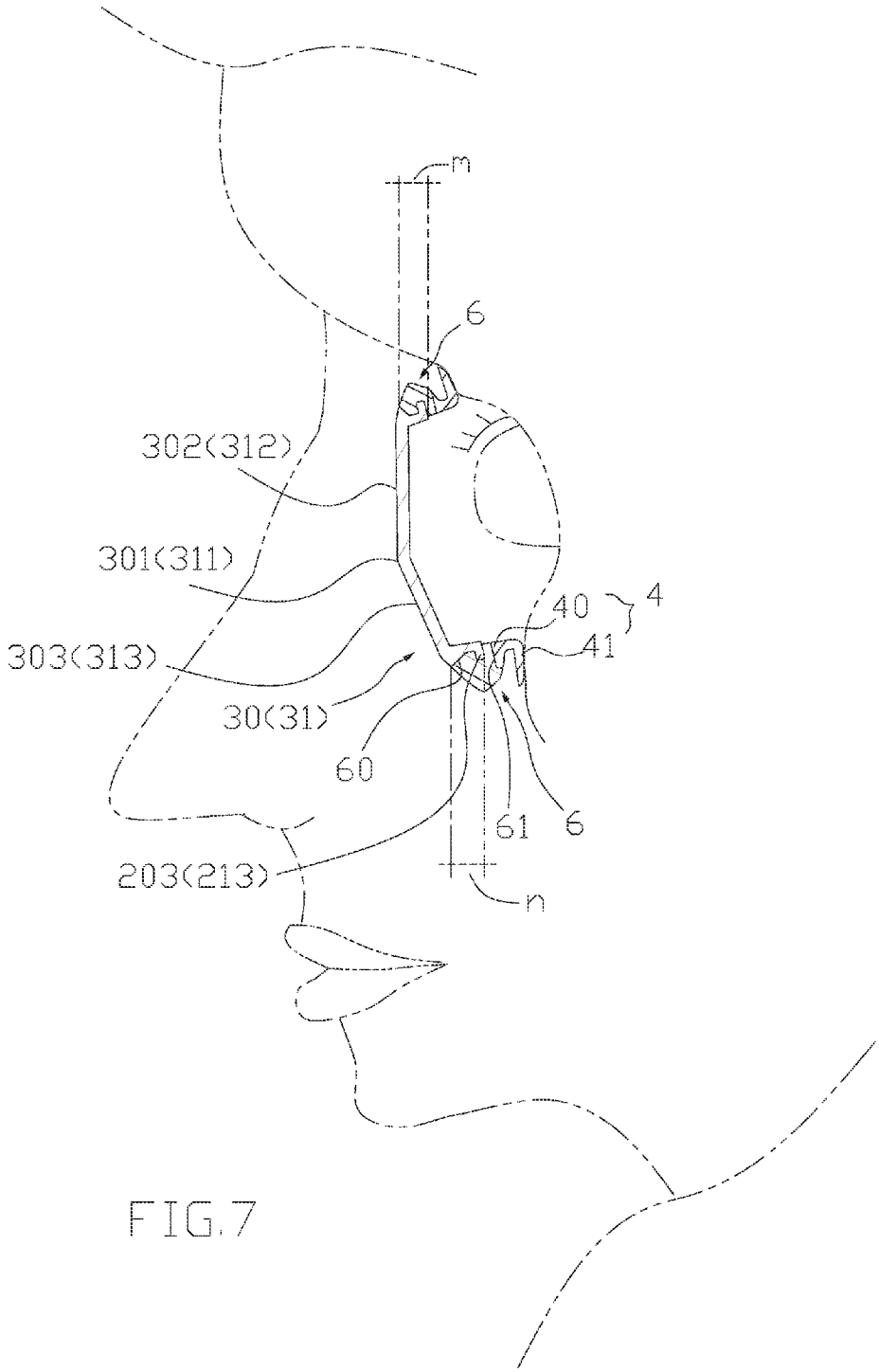
FIG. 7 is a schematic view illustrating that the swimming goggles are in a state of being worn on a wearer.
Figure 8:
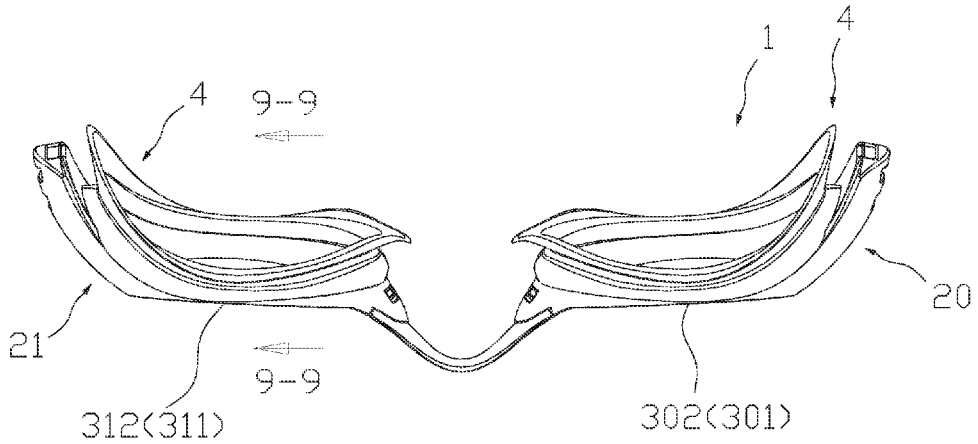
FIG. 8 is a schematic view illustrating the swimming goggles having a first fold surface that is parallel to wearer's eyes.
Figure 9:
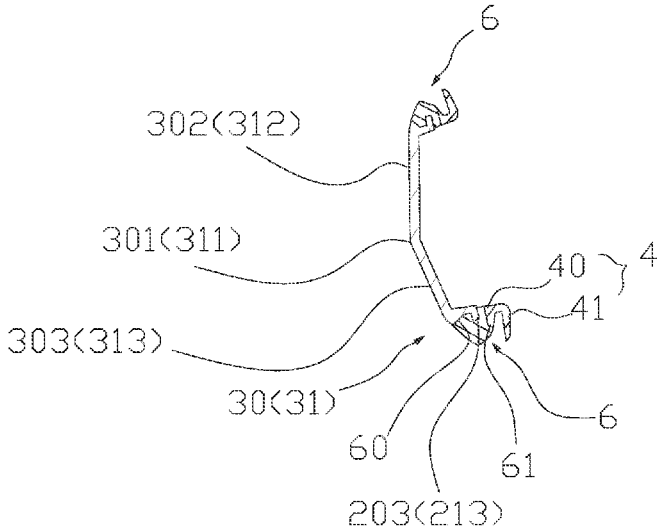
FIG. 9 is a cross-sectional view taken along lines 9-9 of FIG. 8.

Referring to FIGS. 1 to 9, a first embodiment has been introduced. In this embodiment, swimming goggles 1 of the present invention comprise a left frame body 20, a right frame body 21, a connecting element 22, lenses 30 and 31 received in the left and right frame bodies 20 an 21, protective pads 4, head strap bases 5 and backup rings 6. The left and right frame bodies 20 and 21 are made of polycarbonate resin and respectively have inner peripheral faces 201, 211 and outer peripheral faces 202, 212, wherein the inner peripheral faces 201 and 211 are integrally formed with hook channels 203, 213 (as shown in FIG. 5, FIG. 7) for facilitating a grab with the backup rings 6 in the injection molding of plastic material.

The hook channels 203, 213 respectively extend rearward from and along the inner peripheral faces 201, 211 to form a substantially L shape in cross section. Each of the hook channels 203, 213 has a rear face opposite to the outer peripheral faces 202, 212. Contours of the outer peripheral faces 202, 212 of the left and right frame bodies 20, 21 are fit to face portions with respect to inner peripheries of eye sockets of a cranium of a wearer. More specific, each of the face portions is defined to correspond to an upper inner periphery of the eye socket below an eyebrow, a lower side of an under-eye bag with respect to a lower inner periphery of the eye socket, a side portion of a nose bridge adjacent to lacrimal gland, and an outer eye corner with respect to an inner periphery of the eye socket adjacent to a temple. In this manner, after wearing, upper and lower edges of the outer peripheral faces 202, 212 of the left and right frame bodies 20, 21 are positioned to correspond to the inner peripheries of the eye sockets of the cranium. Furthermore, in vertical cross section each of the left and right frame bodies 20, 21 has a thickness m with respect to the eyebrow and a thickness n with respect to the lower side of the under-eye bag, wherein the thickness m is different than the thickness n (as shown in FIG. 7). The thicknesses m and n are respectively defined to be measured from the inner peripheral faces 201, 211 to surfaces of the lenses 30, 31. In this embodiment, regarding the left frame body 20, the thickness m at an upper edge thereof is measured from the rear face of the hook channel 203 to the surface of the lens 30 and is less than the thickness n at a lower edge of the left frame body 20 measured from a rear face of the hook channel 203 to the surface of the lens 30. Likewise, the thicknesses m and n of the right frame body 21 are measured in the same manner as described above. The configuration of different thickness m and n enables the left and right frame bodies 20, 21 to be perfectly fit to contours of the lower sides of the eyebrows and the lower sides of the under-eye bags. Additionally, each of the left and right frame bodies 20, 21 has an arc surface 205 (215) formed between the lacrimal gland and the side portion of the nose bridge so as to allow the left and right frame bodies 20, 21 to be perfectly attached to contours of the side portions of the nose bridge.

The lenses 30, 31 are made of polycarbonate resin and are respectively formed with the outer peripheral faces 202, 212 of the left and right frame bodies 20, 21. The lenses 30, 31 respectively have fold lines 301, 311 corresponding to lower sides of a wearer's eyeballs and define the lenses 30, 31 into first inclined faces 302, 312 and second inclined faces 303, 313 so as to make the size of the first inclined face 302, 312 larger than that of the second inclined faces 303, 313. The first inclined faces 302, 312 are disposed above and incline inward from the fold lines 301, 311. The second inclined faces 303, 313 are disposed below and incline inward from the fold lines 301, 311.

It is noted that the fold lines 301, 311 also can be respectively extended to the outer peripheral faces 202, 212 of the left and right frame bodies 20, 21. When wearing the swimming goggles 1, a wearer pulls a head strap upward that makes the first inclined faces 302, 312 become substantially parallel with the eyes (referring to FIGS. 7-9). In this manner, the lenses 30, 31 inclines their sides adjacent to the connecting element 22 toward the outer peripheral faces 202, 212 of the left and right frame bodies 20, 21, wherein the outer peripheral faces 202, 212 gets away from X axis (referring to FIG. 7). As above, the fold lines 301 and 311 are disposed as parallel with the eyes to make sure that the range of visual filed does not be blocked by the left and right frame bodies 20, 21, and the lenses 30, 31 are disposed as inclined along with the outer peripheral faces 202, 212 of the left and right frame bodies 20, 21 to produce the extended side visual field and reduce the water resistance, thereby lowering the water resistance and providing a better visual field in swimming.

The connecting element 22 is being arc and has engaging pegs 221, 222 at opposite ends thereof (as shown in FIG. 5). The outer peripheral faces 202, 212 of the left and right frame bodies 20, 21 corresponding to the engaging pegs 221, 222 are extended to form engaging seats 204, 214 for being engaged with the engaging pegs 221, 222, and the engaging seats 204, 214 are located above the fold lines 301, 311 of the lenses 30, 31 (referring to FIG. 4). Alternatively, the connecting element 22 is capable of having different shape designs in practice in order for varied contours of nose bridges, as well as being integrally formed with the connection portion of the protective pad 4.

Figure 1:
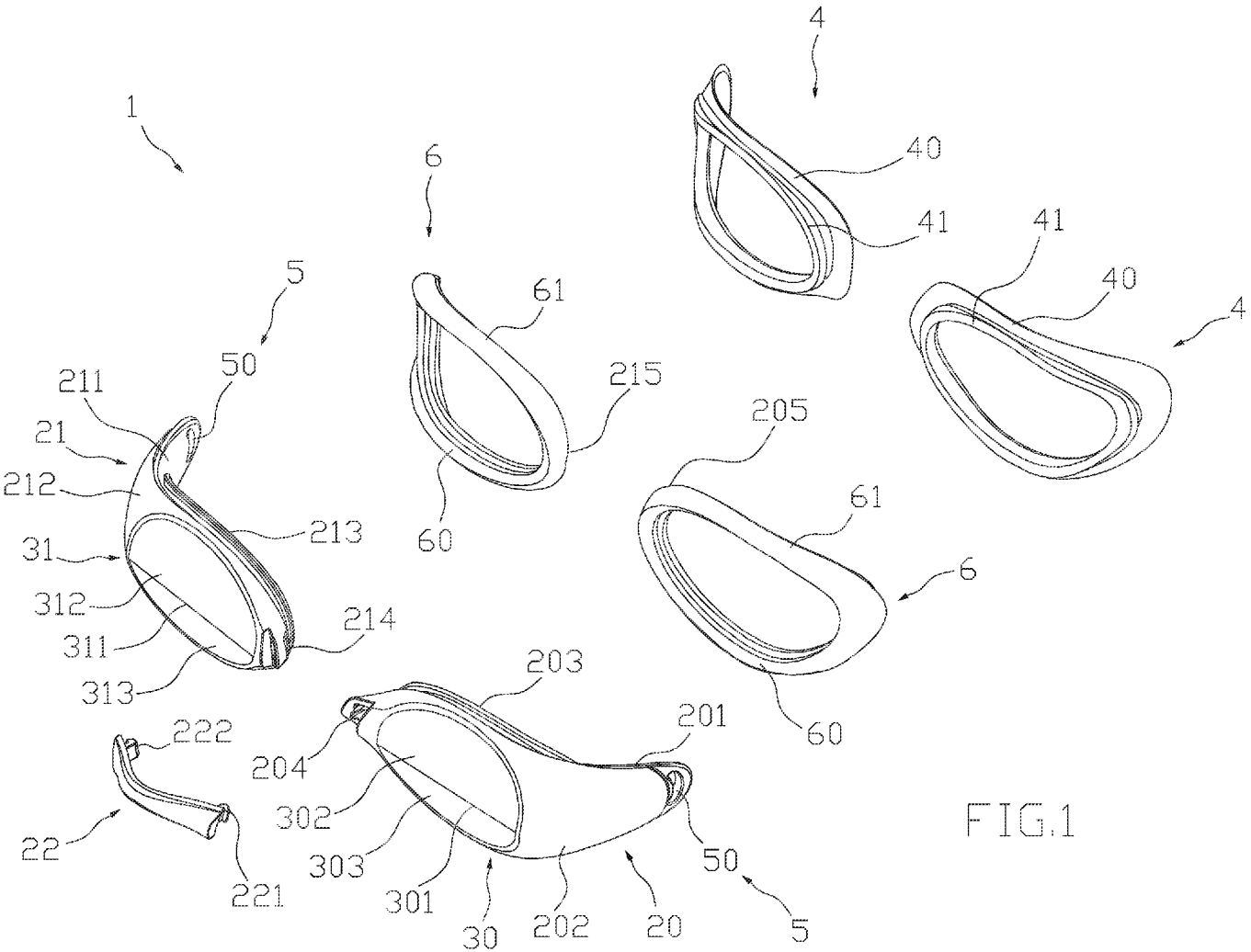
FIG. 1 is an exploded perspective view of swimming goggles of the present invention.
Figure 2:
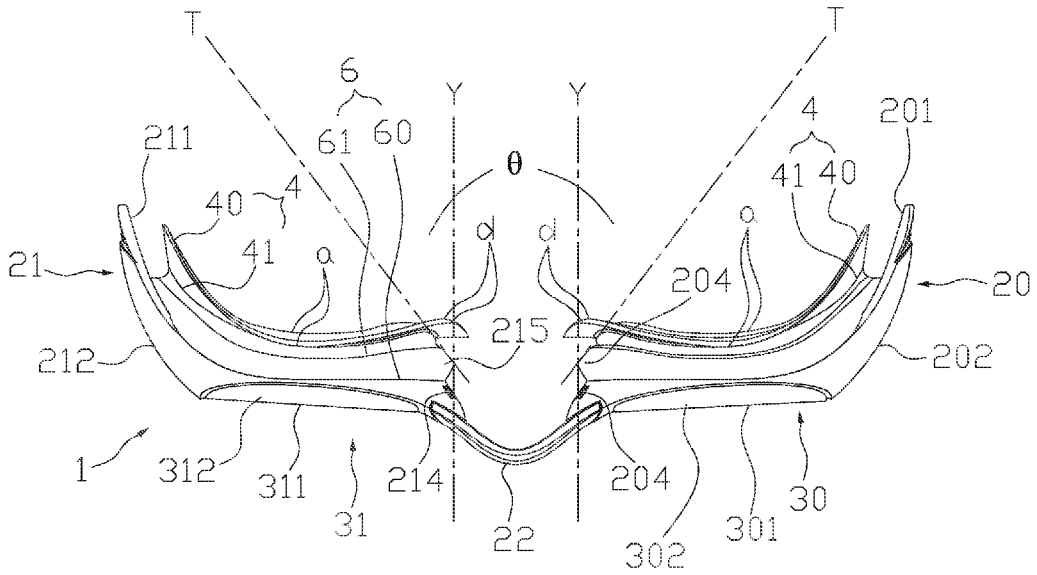
FIGS. 2 and 3 are respectively a top plan view and a bottom plan view of FIG. 1.
Figure 3:
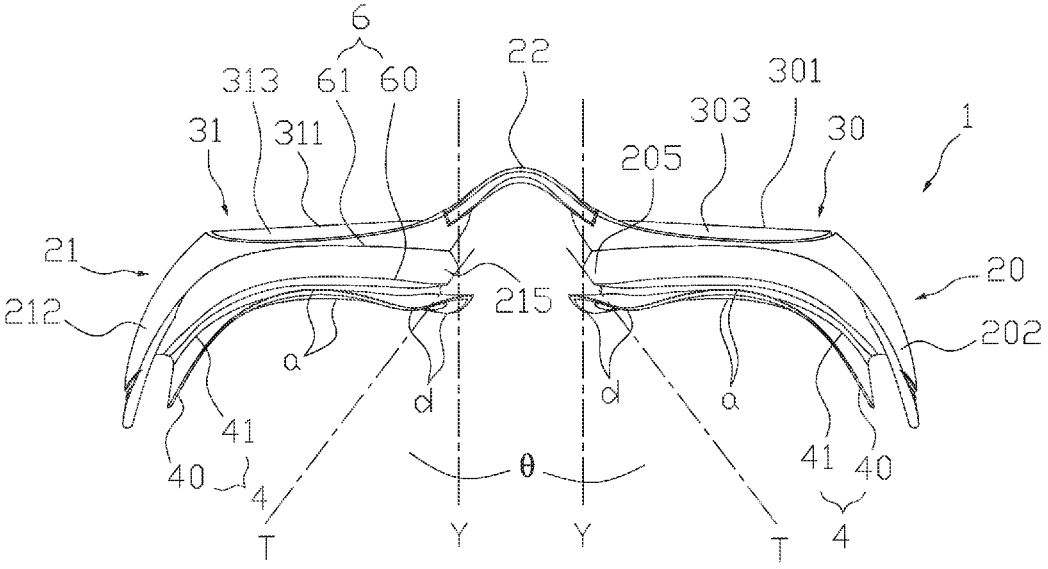
Figure 4:
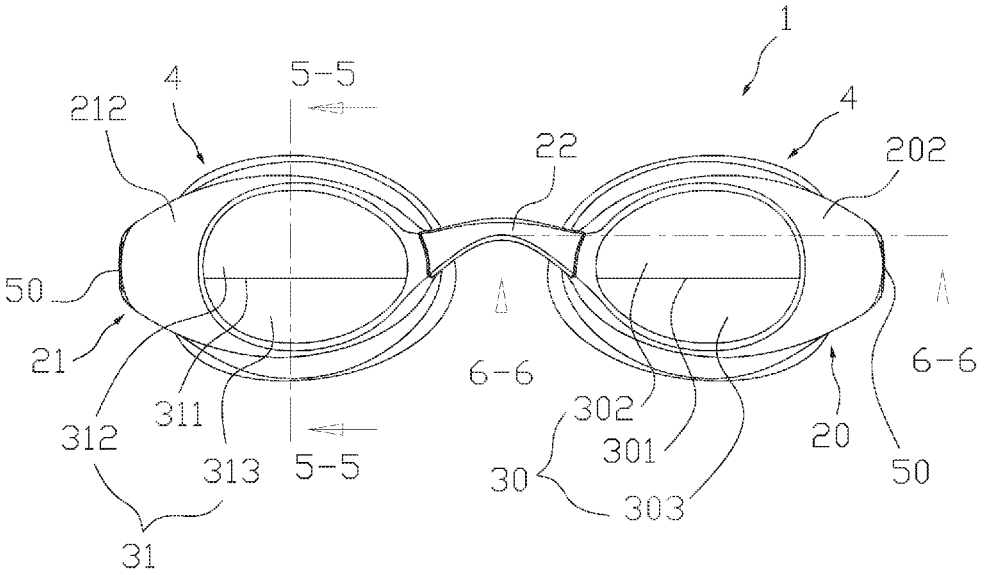
FIG. 4 is a front elevational view of FIG. 1.

The protective pads 4 are respectively attached to the inner peripheral faces 201, 211 of the left and right frame bodies 20, 21. Each of the protective pads 4 has a face contact portion 40 and a connecting portion 41 both made of therma plastic rubber (TPR) for providing a comfortable contact in wearing. It is particularly noted that as the swimming goggles 1 of the present invention is viewed from top or bottom, as shown in FIGS. 2-3, the face contact portions 40 of the protective pads 4 are respectively in a continuous curved shape; that is, in corresponding to the contours of the lower side of the eyebrow and the lower side of the under-eye bag, the face contact portion 40 is nearly in contact with the connecting portion 41 with a gap formed therebetween, and thus a first recess a in a curved shape is being formed. A second recess d in a curved shape is formed with respect to the arc surface 205 (215) of the left (right) frame body 20 (21), whereby the first recess a and the second recess d enable the swimming goggles 1 to be ergonomic to the face portions with respect to the inner peripheries of the eye sockets of the cranium. Besides, the arc surface 205 (215) also helps the swimming goggles 1 to fit into the face portions with respect to the inner peripheries of the eye sockets of the cranium.

The head strap bases 5 are respectively disposed on outer sides of the left and right frame bodies 20, 21. Each of the head strap bases 5 forms a through hole 50 having a horizontal middle line that is positioned above the fold line 301 (311) of the lens 30 (31) so as to allow a head strap (not shown) to be adjusted therethrough. Furthermore, each of the head strap bases 5 is oblique to the first inclined face 302 (312) so as to allow the first inclined face 302 (312) to remain a position being parallel with the eyes when the head strap is being drawn in wearing (as shown in FIG. 7), whereby the swimming goggles 1 are capable of being positioned in the eye sockets.

The backup rings 6 each forms a first peripheral face 60 and a second peripheral face 61. When configured, the first peripheral face 60 integrally encompasses the hook channels 203, 213 of the inner peripheral faces 201, 211, and the second peripheral face 61 is formed with the connecting portion 41 (see FIG. 5, FIG. 6). Next, the second peripheral face 61 is positioned on a side of the connecting element 22 and forms the arc surface 205, 215. A tangent line T of the arc surface 205, 215 and a Y axial line passing through the point of tangency cooperatively form an angle θ less than 90 degree (see FIG. 2, FIG. 3), whereby making the left frame body 20 and the right frame body 21 perfectly fit into both sides of the bridge of nose without further adjustments after wearing.

Accordingly, please referring to FIG. 7, which shows that the upper and lower edges of the face contact portions 40 of the protective pads 4 are respectively fit to the lower sides of the eyebrows and the lower sides of the under-eye bags, that the left frame body 20 and the right frame body 21 perfectly fit to face portions with respect to inner peripheries of eye sockets of a cranium of a wearer, thereby making the first inclined face 302, 312 remain a position being parallel with the eyes, and further, the backup rings 6 are disposed to prevent wearer's eyelashes from coming into contact with the lenses 30, 31. Further, the configuration of different thickness m, n enables the left and right frame bodies 20, 21 to be perfectly fit to contours of the lower sides of the eyebrows and the lower sides of the under-eye bags. In the other words, the thickness m at the lower sides of the eyebrows is less than the thickness n at the lower sides of the under-eye bags, and the contours of the face contact portions 40 of the protective pads 4 are fit to the face portions with respect to the inner peripheries of the eye sockets of the cranium, in order to ensure that the swimming goggles are being comfortably worn in place without water leakage.

Figure 10:
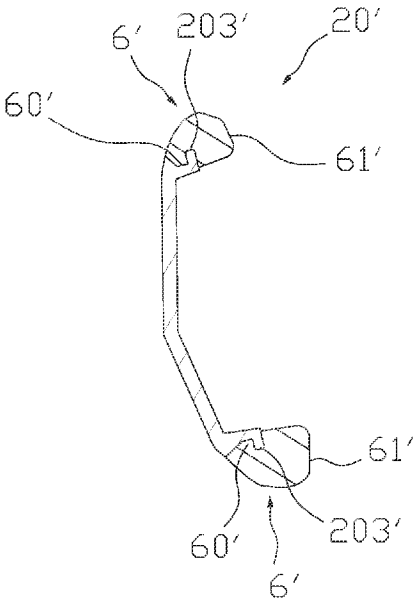
FIGS. 10-12 are schematic views illustrating the second embodiment of the present invention, including a cross-sectional view of the frame body and a schematic view of the swimming goggles being worn on a wearer.
Figure 11:
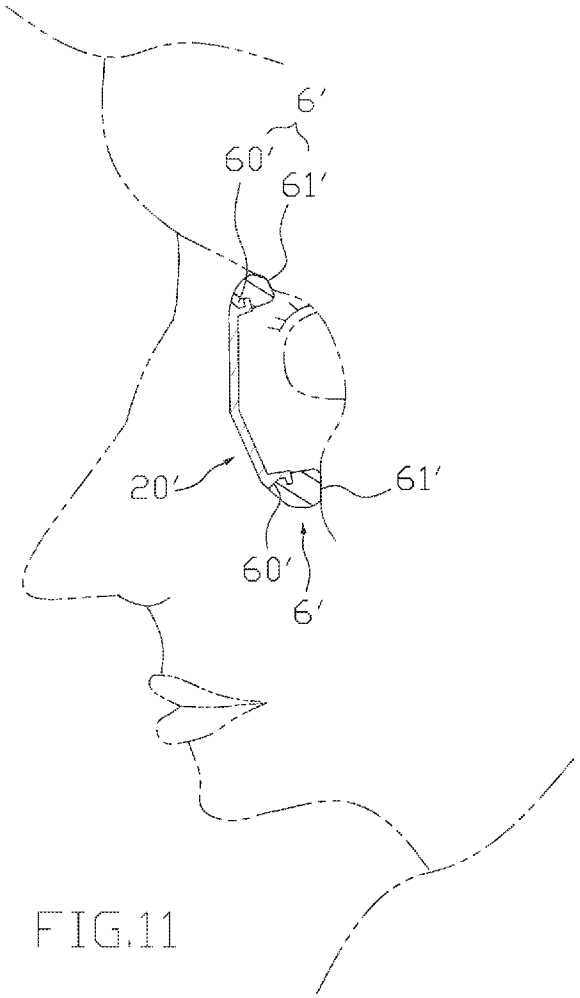
Figure 12:
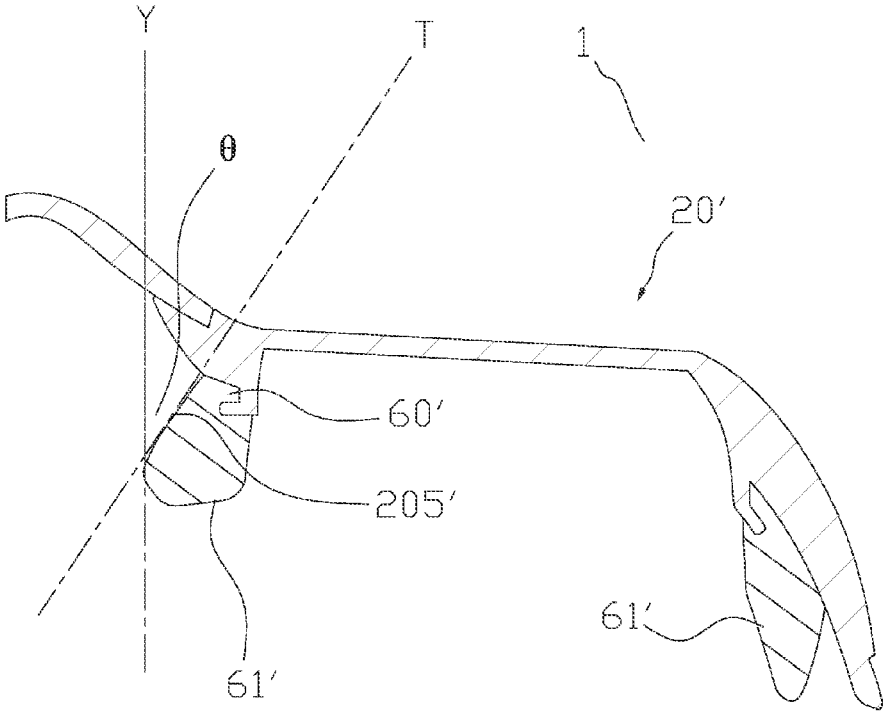

Please referring to FIGS. 10-12 illustrating a second embodiment of swimming goggles 1' of the present invention, major differences between the first and second embodiments are that the protective pads 4 are replaced by the backup rings 6, i.e., the first peripheral face 60' encompasses the hook channel 203' of the left frame body 20' and the second peripheral face 61' forms the contours fit to the face portions with respect to the inner peripheries of the eye sockets of the cranium, and the second peripheral face 61' further has the arc surface 205' so as to perfectly fit into both sides of the bridge of nose without further adjustments after wearing and to ensure that the swimming goggles are being comfortably worn in place without water leakage and also reduce the water resistance.

It is understood that the invention may be embodied in other forms within the scope of the claims. Thus the present examples and embodiments are to be considered in all respects as illustrative, and not restrictive, of the invention defined by the claims.

What is claimed is:

1. Swimming goggles, comprising:

a left frame body and a right frame body, each of the left and right frame bodies having an inner peripheral face and an outer peripheral face, the outer peripheral faces of the left and right frame bodies being fit to face portions with respect to inner peripheries of eye sockets of a cranium of a wearer, and further, the inner peripheral face forming a hook channel therealong;

lenses being respectively integrally formed with the outer peripheral faces of the left and right frame bodies, each of the lenses having a fold line to define the lens into a first inclined face and a second inclined face, the first inclined face being disposed above the fold line and inclining inward from the fold line, and the second inclined face being disposed below the fold line and inclining inward from the fold line;

a connecting element interconnecting the left and right frame bodies;

protective pads being respectively attached to the inner peripheral faces of the left and right frame bodies, each of the protective pads having a face contact portion and a connecting portion, and contours of the face contact portions being fit to the face portions with respect to the inner peripheries of the eye sockets of the cranium; and head strap bases being respectively disposed on outer sides of the left and right frame bodies, each of the head strap bases forming at least one through hole on the outer side of each of the left and right frame bodies; wherein a backup ring is disposed between the connecting portion and the hook channel, and has a first peripheral face and a second peripheral face, such that the first peripheral face integrally encompasses the hook channel of the inner peripheral face and also the second peripheral face forms with the connecting portion, thereby, the swimming goggles could be worn comfortably in swimming.

2. The swimming goggles of claim 1, wherein the second peripheral face is positioned on a side of the connecting element and forms an arc surface, and a tangent line of the arc surface and a Y axial line passing through the point of tangency cooperatively form an angle less than 90 degree, whereby making the left frame body and the right frame body perfectly fit into both sides of the bridge of nose without further adjustments after wearing.

3. The swimming goggles of claim 1, wherein the fold lines are corresponding to lower sides of a wearer's eyeballs so as to make the size of the first inclined face larger than that of the second inclined face.

4. The swimming goggles of claim 1, wherein the lenses inclines their sides adjacent to the connecting element toward the outer peripheral faces of the left and right frame bodies so as to produce the extended side visual field and reduce the water resistance.

5. The swimming goggles of claim 1, wherein the fold lines are respectively extended to the outer peripheral faces of the left and right frame bodies.

6. The swimming goggles of claim 1, wherein the connecting element is being arc and is integrally formed with the connecting portions of the protective pads.

7. The swimming goggles of claim 1, wherein the connecting element is being arc and has engaging pegs at opposite ends thereof, and the outer peripheral faces of the left and right frame bodies corresponding to the engaging pegs are extended to form engaging seats for being engaged with the engaging pegs, wherein the engaging seats are located above the fold lines of the lenses.

8. The swimming goggles of claim 1, wherein the connecting portions and the face contact portions of the protective pads are capable of being made of a same material or different materials, such that when the connecting portions and the face contact portions are made of a same material, the connecting portions are made thicker than the face contact portions to form with the second peripheral and the face contact portions are made thinner than the connecting portions for comfortably fitting to wearer's face, or when the connecting portions and the face contact portions are made of different materials, the connecting portions are made of a composite material capable of combining the left and right frame bodies with the face contact portions.

9. The swimming goggles of claim 1, wherein the connecting portions and the face contact portions of the protective pads are made of different colors.

10. Swimming goggles, comprising:

a left frame body and a right frame body, each of the left and right frame bodies having an inner peripheral face and an outer peripheral face, the outer peripheral faces of the left and right frame bodies being fit to face portions with respect to inner peripheries of eye sockets of a cranium of a wearer, and a hook channel extending from and along the inner peripheral face of each of the left and right frame bodies;

lenses respectively integrally formed with the outer peripheral faces of the left and right frame bodies, each of the lenses having a fold line to define the lens into a first inclined face and a second inclined face;

a connecting element interconnecting the left and right frame bodies;

a backup ring having a first peripheral face and a second peripheral face, wherein the first peripheral face integrally encompasses the hook channel of the inner peripheral face, and the second peripheral face having a contour fitting to the face portions with respect to the inner peripheries of the eye sockets of the cranium is positioned on a side of the connecting element and forms an arc surface, and further, a tangent line of the arc surface and a Y axial line passing through the point of tangency cooperatively form an angle less than 90 degree; and head strap bases respectively disposed on outer sides of the left and right frame bodies, each of the head strap bases forming at least one through hole on the outer side of each of the left and right frame bodies.

* * * * *